US008295521B2

(12) United States Patent
Chan et al.

(10) Patent No.: US 8,295,521 B2
(45) Date of Patent: Oct. 23, 2012

(54) HEARING APPARATUS COMPRISING A MEMBRANE ON THE BATTERY COMPARTMENT INTERIOR

(75) Inventors: Hoong Yih Chan, Singapore (SG); PhanHow Amy Cheng, Singapore (SG); Leep Foong Chew, Singapore (SG); Cheoung Hong Lee, Singapore (SG); Meng Kiang Lim, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 225 days.

(21) Appl. No.: 12/577,819

(22) Filed: Oct. 13, 2009

(65) Prior Publication Data

US 2010/0098279 A1 Apr. 22, 2010

(30) Foreign Application Priority Data

Oct. 16, 2008 (DE) ..... 10 2008 051 925

(51) Int. Cl.
*H04R 25/00* (2006.01)

(52) U.S. Cl. ..... 381/323; 381/322; 381/312

(58) Field of Classification Search ..... None
See application file for complete search history.

(56) References Cited

U.S. PATENT DOCUMENTS

| | | | | |
|---|---|---|---|---|
| 3,909,302 | A | 9/1975 | Mermelstein | |
| 4,634,815 | A | 1/1987 | Marquis | |
| 5,249,234 | A * | 9/1993 | Butler | 381/322 |
| 5,341,433 | A * | 8/1994 | Meyer et al. | 381/324 |
| 5,538,605 | A | 7/1996 | Joshi et al. | |
| 6,041,128 | A | 3/2000 | Narisawa et al. | |
| 6,208,741 | B1 * | 3/2001 | Shennib et al. | 381/323 |
| 7,123,733 | B1 | 10/2006 | Borowsky et al. | |
| 2007/0003084 | A1 * | 1/2007 | Huynh et al. | 381/323 |
| 2007/0003087 | A1 | 1/2007 | Ram et al. | |
| 2009/0092270 | A1 * | 4/2009 | Ho et al. | 381/324 |

FOREIGN PATENT DOCUMENTS

| | | | |
|---|---|---|---|
| DE | 19502994 | C2 | 5/1998 |
| DE | 19903090 | A1 | 8/2000 |
| DE | 10206621 | A1 | 9/2003 |
| WO | 9608048 | A1 | 3/1996 |
| WO | WO 0079836 | A1 | 12/2000 |

* cited by examiner

*Primary Examiner* — Yuwen Pan
*Assistant Examiner* — Taunya McCarty

(57) ABSTRACT

A hearing apparatus with a housing including a housing interior is provided. Signal processing components are accommodated in the housing interior. The hearing apparatus includes a battery compartment fastened in or on the housing, which has a battery compartment interior into which a battery is inserted for supplying power to the hearing apparatus. Further, a membrane is provided, which separates the housing interior from the battery compartment interior. The membrane is fastened to the housing or to the battery compartment.

13 Claims, 3 Drawing Sheets

HEARING APPARATUS COMPRISING A MEMBRANE ON THE BATTERY COMPARTMENT INTERIOR

CROSS REFERENCE TO RELATED APPLICATIONS

This application claims priority of German Patent Application No. 10 2008 051 925.1 DE filed Oct. 16, 2008, which is incorporated by reference herein in its entirety.

FIELD OF INVENTION

The present invention relates to a hearing apparatus comprising a housing including a housing interior, in which signal processing components are accommodated, and a battery compartment, which is fastened in or on the housing and which has a battery compartment interior, into which a battery can be inserted for supplying power to the hearing apparatus. The term hearing apparatus is understood here to mean any sound-emitting device which can be worn in/on the ear or head, in particular a headset, a hearing device, earphones and suchlike.

BACKGROUND OF INVENTION

Hearing devices are wearable hearing apparatuses which are used to assist the hard-of-hearing. In order to accommodate numerous individual requirements, various types of hearing devices are available such as behind-the-ear hearing device (BTEs), hearing device with an external receiver (RIC: receiver in the canal) and in-the-ear hearing devices (ITE), for example also concha hearing devices or completely-in-the-canal hearing devices (ITE, CIC). The hearing devices listed as examples are worn on the outer ear or in the auditory canal. Bone conduction hearing aids, implantable or vibrotactile hearing aids are also available on the market. In these devices damaged hearing is stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

Hearing devices are very sensitive devices which may however be subject to relatively aggressive environments. It is not only the high air humidity which has to be considered here but also the sweat produced by a hearing device wearer and more aggressive gases and vapors to which the hearing device wearer is exposed at times. Aggressive environmental conditions of this type frequently result in electrical components of the hearing device corroding. Corresponding farms and coatings of hearing device housings were therefore previously proposed in order to prevent aggressive substances from penetrating the hearing device housing.

The publication DE 199 03 090 A1 discloses a waterproof hearing aid. It includes a housing with a battery compartment as well as a sound outlet opening. The battery compartment is sealed from the remaining housing in a waterproof fashion. The sound outlet opening is sealed by an acoustically permeable, waterproof film.

The publication DE 195 02 994 C2 discloses a similarly waterproof hearing aid, which includes a housing with a ventilation opening. A waterproofing facility blocks the ventilation opening and is used to allow air to enter but to prevent the penetration of humidity.

SUMMARY OF INVENTION

In many cases hearing devices are nowadays operated with zinc-air batteries. Prior to the use of these zinc-air batteries, the air holes on the upper side of the battery housing are sealed with an adhesive tape. This prevents air, in particular oxygen, from the environment from reacting with the zinc of the battery. This type of non-chargeable electrochemical battery namely generates the electrical energy by means of the oxidization of zinc with the oxygen in the air.

If the hearing device wearer wishes to use the battery in his/her hearing device, he will firstly remove the adhesive strip from the zinc-air battery. As soon as the adhesive strip is detached, oxygen will penetrate the air holes of the battery. The atmospheric oxygen, which acts as a cathode during the reaction, will react with the aqueous zinc anode in the battery. Corresponding electrical charges result from the reaction.

White, powdery deposits which originate from the air holes of the battery quite often appear on the zinc-air battery. These deposits can be caused by the electrolyte material kalium hydroxide (KOH) in the battery. KOH is very mobile in conjunction with steam and water and is relatively aggressive particularly in respect of light metals.

An object of the present invention therefore consists in protecting the switching elements in a hearing apparatus from corrosion in a simple fashion.

The object is achieved by a hearing apparatus comprising a housing including a housing interior, in which signal processing components are accommodated, and a battery compartment, which is fastened in or on the housing and which has a battery compartment interior, into which a battery can be inserted for supplying power to the hearing apparatus, as well as a membrane, which separates the housing interior from the battery compartment interior.

The membrane can advantageously prevent aggressive substances originating from a battery from reaching the interior of a hearing apparatus and/or hearing device and resulting there in the corrosion of electronic components or other elements. The membrane can in particular filter out from the air and/or prevent the flow of sediments developing as a result of leakages in the battery. The amplifier in particular, but also electromechanical components such as the receiver, microphone, switches and suchlike can be protected against corrosion.

The membrane is preferably fastened in the hearing apparatus in an exchangeable fashion. It is therefore also possible to change the membrane when changing the battery, said membrane being filled and/or saturated with aggressive substances.

The battery compartment can also be pivoted into the housing. A battery compartment of this type enables the battery to be exchanged in a user-friendly fashion.

In a special embodiment, the membrane can be fastened in or on the housing. This is advantageous in that is possible to cause barely any damage to the membrane when exchanging a battery.

The housing can especially comprise a frame and the membrane can be fastened to the frame. The protective function of the membrane is therefore retained even when the housing shells fastened to the frame are exchanged for instance.

With an alternative embodiment, the membrane is fastened in or on the battery compartment. This embodiment is advantageous in that the membrane can be easily replaced by a rotating and/or sliding movement for instance, since it is then easily accessible.

The membrane can also be soft and pliable. This is then particularly favorable if the membrane is to be inserted behind projections in the housing and/or battery compartment.

In particular, the membrane is to be acid-resistant. This is understood to mean in particular that the membrane is resistant to caustic potash, in other words the aqueous solution from kalium hydroxide. It is also favorable for the membrane to be hydrophilic. A membrane of this type may contribute to the air in the hearing device and/or in the hearing apparatus being dehumidified.

BRIEF DESCRIPTION OF THE DRAWINGS

The present invention is described in more detail below with reference to the appended drawings, in which.

DETAILED DESCRIPTION OF INVENTION

The exemplary embodiments illustrated in more detail below represent preferred embodiments of the present invention.

Figure 1:
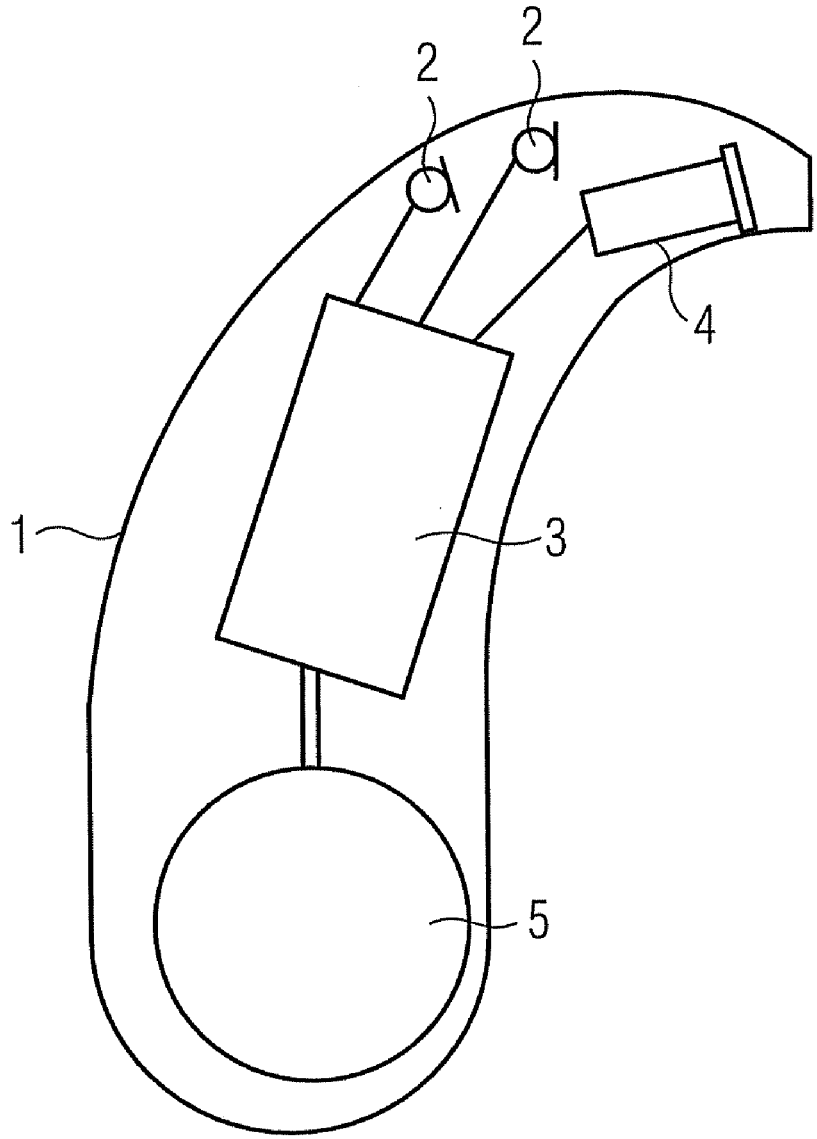
FIG 1 (Prior art)
FIG. 1 shows the schematic design of a hearing device according to the prior art.
Figure 2:
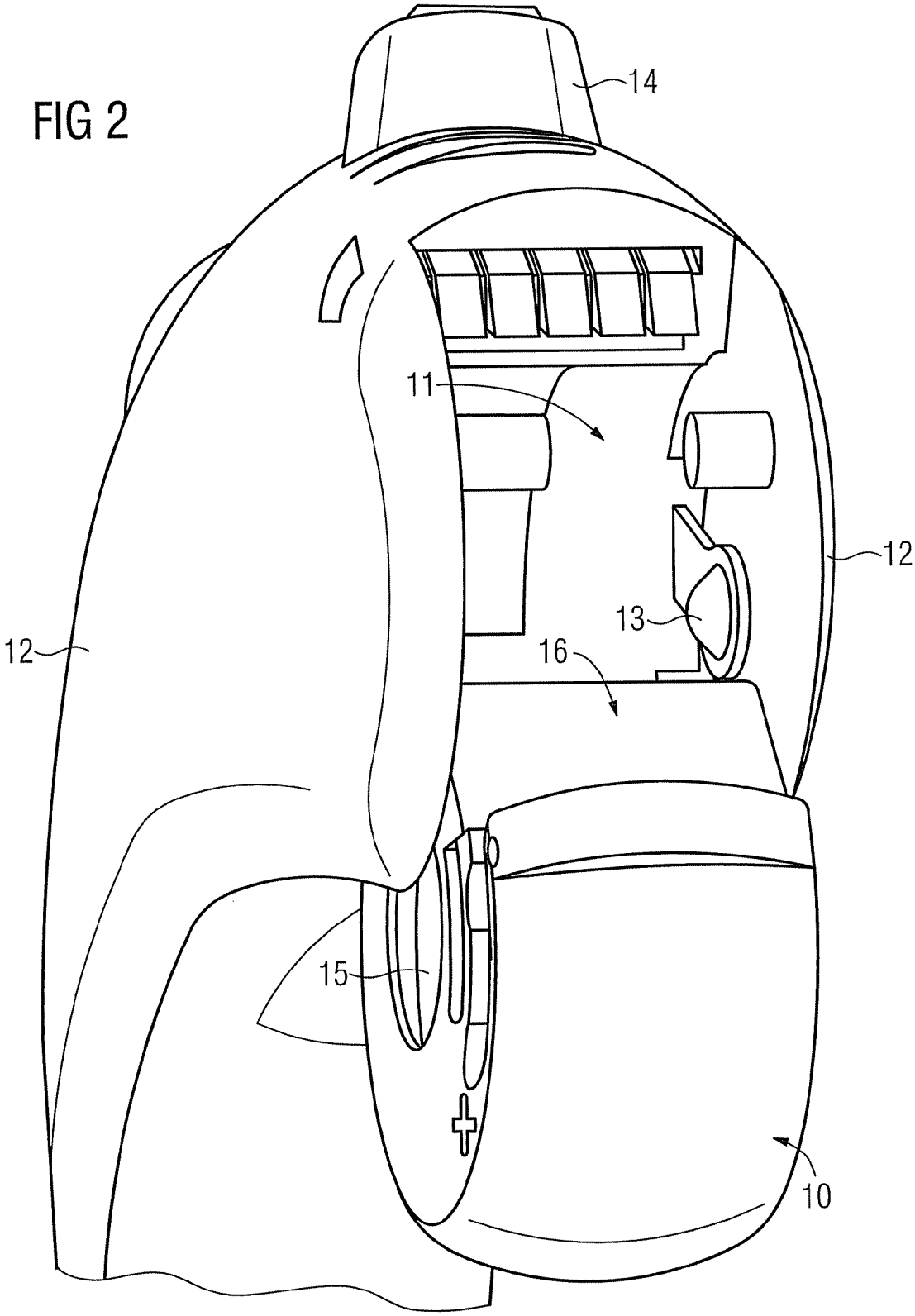
FIG. 2 shows a lower side view of a BTE hearing device in accordance with a first embodiment and FIG. 3 shows the lower side view of a BTE hearing device in accordance with a second embodiment.

FIG. 2 shows a part of a BTE hearing device with an open battery compartment 10. The battery compartment 10 is fastened to the frame 11 in a pivotable fashion. Housing shell parts 12 are likewise fastened to the frame 11. A housing interior, in which electronic components such as the amplifier, receiver, microphone and suchlike are arranged, result from the housing, in the present instance the housing frame 11 and housing shell 12. A battery contact 13 in the housing of the hearing device as well as a switch 14 is also visible in FIG. 2 from outside the housing.

The pivotable battery compartment 10 has a battery compartment interior 15, into which a battery can be inserted. A membrane 16 is attached to the side of the battery compartment facing toward the housing interior. It is embodied here in an approximately half-circular form and closes the battery compartment interior 15, as far as possible, off from the housing interior when the battery compartment 10 is in a closed state. To this end, the membrane 16 is approximately equally as wide as the battery compartment 10. I.e. the extension of the membrane 16 in the axial direction of the battery compartment 10 corresponds approximately to the axial extension of the cylindrical battery compartment.

The purpose of the membrane 16 is to absorb and/or filter out aggressive substances, which leave the battery and could reach the housing interior through an air flow for instance. The membrane is therefore selected such that it is resistant to acid and alkali. It is in particular able to absorb, bind and if necessary chemically transform chemical depositions from the battery.

The membrane 16 can also be embodied to be soft and easily pliable. This allows it to be easily applied to parts of the battery compartment. By way of example, bismaleimide polymers, which are characterized by their excellent solvent resistance, can be used in particular for the membrane 16. Polyethersulfone membranes can likewise be used if the emphasis is on hydrophilic properties and particles are to be filtered out.

As was already indicated, the membrane 16 can be easily exchanged. This is not only due to the membrane material but also to the fact that the membrane 16 is fastened to the pivotable battery compartment 10. By pivoting the battery compartment 10, that part of the battery compartment, which is in the housing in a pivoted state, is pivoted outwards. As the membrane rests on this part of the battery compartment which is outwardly pivotable, it is easily accessible when the battery compartment is in the pivoted state.

Figure 3:
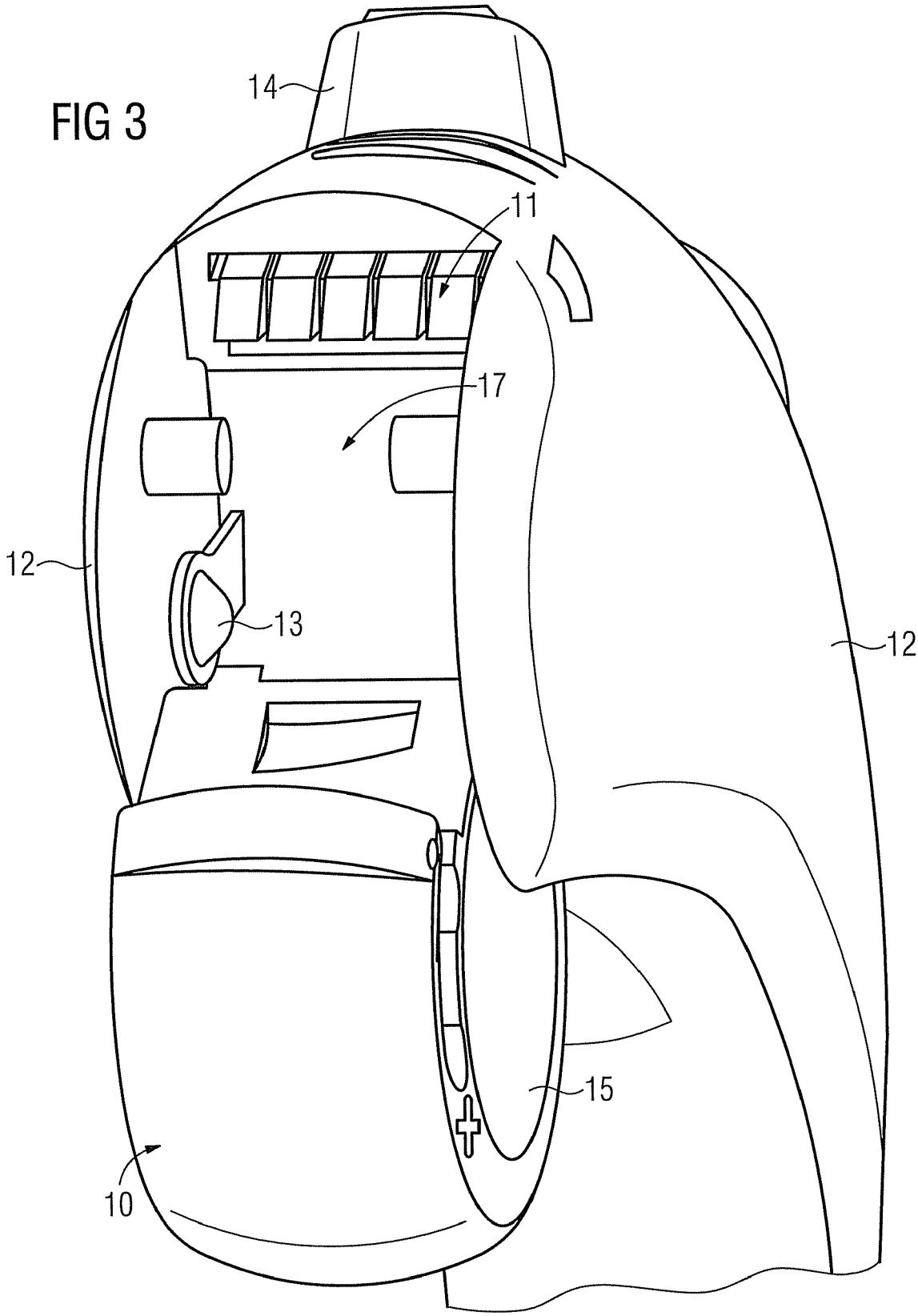

FIG. 3 shows a further embodiment of the present invention. FIG. 3 in particular likewise shows a view of a lower part of a BTE hearing device. This hearing device essentially has the same components as those in FIG. 2, as a result of which the same reference characters are largely used. In particular, a pivotable battery compartment 10, a frame 11, housing shell 12, a battery contact 13, a switch 14 and a battery interior 15 are likewise visible. With this exemplary embodiment, a membrane 17 is not attached directly to the battery compartment 10 but is instead attached in the housing and/or on the frame 11. This membrane 17 is located at a point at which the battery compartment within the housing ends terminates in its pivoted state. It therefore also outwardly closes off the housing interior, in which in particular the amplifier, receiver, microphones and such like are found, when the battery compartment 10 is in a pivoted state. This embodiment therefore protects the membrane 17, in other words the housing interior, not only from aggressive substances from the battery but also from external environmental influences.

The membrane 17 is otherwise embodied like the membrane in the preceding example according to FIG. 2, relating in particular to the material. The advantages of membrane 16 thus also result here for membrane 17.

The invention claimed is:

1. A hearing apparatus, comprising:

a housing including a housing interior;

signal processing components accommodated in the housing interior;

a battery compartment fastened in or on the housing, the battery compartment including a battery compartment interior;

a battery for supplying power to the hearing apparatus, the battery being inserted in the battery compartment interior; and a membrane separating the housing interior from the battery compartment interior;

wherein the battery compartment is pivotable from in the housing outwards to a pivoted state out of the housing;

wherein the membrane is fastened in or on the battery compartment such that upon said battery compartment being pivoted from in the housing to the pivoted stated out of the housing, said membrane is accessible to be exchanged.

2. The hearing apparatus as claimed in claim 1, wherein the battery compartment is pivotable from the pivoted state out of the housing into the housing.

3. The hearing apparatus as claimed in claim 1, wherein the housing includes a frame and the membrane is fastened to the frame.

4. The hearing apparatus as claimed in claim 1, wherein the membrane is soft and pliable.

5. The hearing apparatus as claimed in claim 1, wherein the membrane is acid-resistant.

6. The hearing apparatus as claimed in claim 4, wherein the membrane is acid-resistant.

7. The hearing apparatus as claimed in claim 1, wherein the membrane is solvent-resistant.

8. The hearing apparatus as claimed in claim 4, wherein the membrane is solvent-resistant.

9. The hearing apparatus as claimed in claim 6, wherein the membrane is solvent-resistant.

10. The hearing apparatus as claimed in claim 1, wherein the membrane is hydrophilic.

11. The hearing apparatus as claimed in claim 4, wherein the membrane is hydrophilic.

12. The hearing apparatus as claimed in claim 6, wherein the membrane is hydrophilic.

13. The hearing apparatus as claimed in claim 9, wherein the membrane is hydrophilic.

* * * * *